United States Patent [19]

Hsieh

[11] Patent Number: 5,076,132

[45] Date of Patent: Dec. 31, 1991

[54] CLAMP MOUNT FOR A MUSICAL DRUM

[76] Inventor: Wu H. Hsieh, No. 178, Chung Shan Erh Rd., Lu Chou Hsiang, Taipei Hsien, Taiwan

[21] Appl. No.: 500,378

[22] Filed: Mar. 28, 1990

[51] Int. Cl.[5] ..... G10D 13/02

[52] U.S. Cl. ..... 84/421

[58] Field of Search ..... 84/421, 411 R

[56] References Cited

U.S. PATENT DOCUMENTS 4,387,839 6/1983 Dranchak ..... 84/421 X
4,640,175 2/1987 Hoshino ..... 84/421
4,709,613 12/1987 Powers et al. ..... 84/421

FOREIGN PATENT DOCUMENTS 77200084 6/1989 Taiwan .

*Primary Examiner*—Brian W. Brown
*Attorney, Agent, or Firm*—Fitch, Even, Tabin & Flannery

[57] ABSTRACT

A clamp mount for a musical drum, to which a clamp is fixable, is formed with an idented tab at each end which slides under and is securable behind a threaded receptacle of the type conventionally provided along the wall of a drum body for accepting a screw for fixing the drum rin to the drum body.

1 Claim, 5 Drawing Sheets

CLAMP MOUNT FOR A MUSICAL DRUM

BACKGROUND OF THE INVENTION

This invention relates to a musical drum, and, more particularly to a clamping mount to which is fixed a clamp for attaching several musical drums together.

Quite often several snare drums are fixed together on a bass drum for convenient use. Prior art, shown in FIG. 5, reveals that, such a clamp is often fixed to a mount mounted directly on the drum body. FIG. 6 shows a clamp mount according to prior art where a cross-sectional cut-away view of a clamping device 3 and a mount 4 are attached to a wall 90 of a drum body. The clamping device 3 comprises a front piece 31 bolted to a rear piece 32. Between the front piece 31 and the rear piece 32 is clamped a means for attaching the drum and the clamping device 3 to a stand in the form of a rod 33.

FIG. 7 shows in particular detail the design of the mount 4 to which the clamp 3 is fixed. The mount 4 includes a shock-absorbing base which is mounted to the wall 90 of the drum body by means of two screws 41. In that the two screws 41 pierce the wall 90 of the drum body, the fixing of the mount 4 to the wall of the drum body compromises the musical integrity of the percussional sound. The musical integrity of the instrument is further altered in that the clamp 3, which is bolted to the mount by bolt 34 and which is of rather sturdy construction in order to best function in the capacity of a rigid clamp, is, in fact, rather weighty and therefore strain the wall of the drum body.

It is the purpose of this present invention, therefore, to mitigate and/or obviate the above-mentioned drawbacks in the manner set forth in the detailed description of the preferred embodiment.

SUMMARY OF THE INVENTION

Accordingly, it is a primary objective of the present invention to provide a mount to which a clamping device is fixable which, when mounted on the wall of the drum body, does not alter the musical integrity of the percussional tone.

It is a further objective of the present invention to provide a mount which is of sturdy construction and is fixed on the wall of the drum body.

It is a further objective of the present invention to provide a mount which is easily fixed on the wall of the drum body.

It is a further objective of the present invention to provide a mount which is of simple construction as well as easy and inexpensive to manufacture.

The clamp mount of the present invention, therefore, is not bolted to the wall of the drum body in order to preserve the musical integrity of the percussional sound. The clamp mount is shaped to straddle between two threaded receptacles into which the screws which clamp the drum rim to the drum body are screwed. Each end of the clamp mount attaches behind one receptacle. A clamp is then fixed to the clamp mount.

Further objectives and advantages of the present invention will become apparent as the following description proceeds, and the features of novelty which characterize the invention are pointed out with particularity in the claims annexed to and forming a part of this invention.

DETAILED DESCRIPTION OF THE PREFERRED EMBODIMENT

Figure 1:
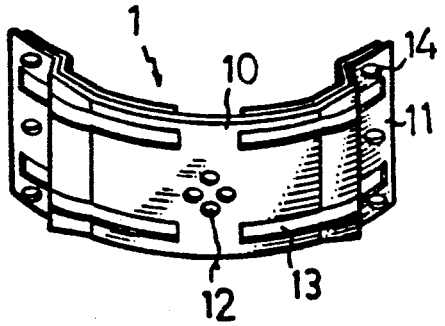
FIG. 1 is a perspective view of a clamp mount in accordance with the present invention.
Figure 2:
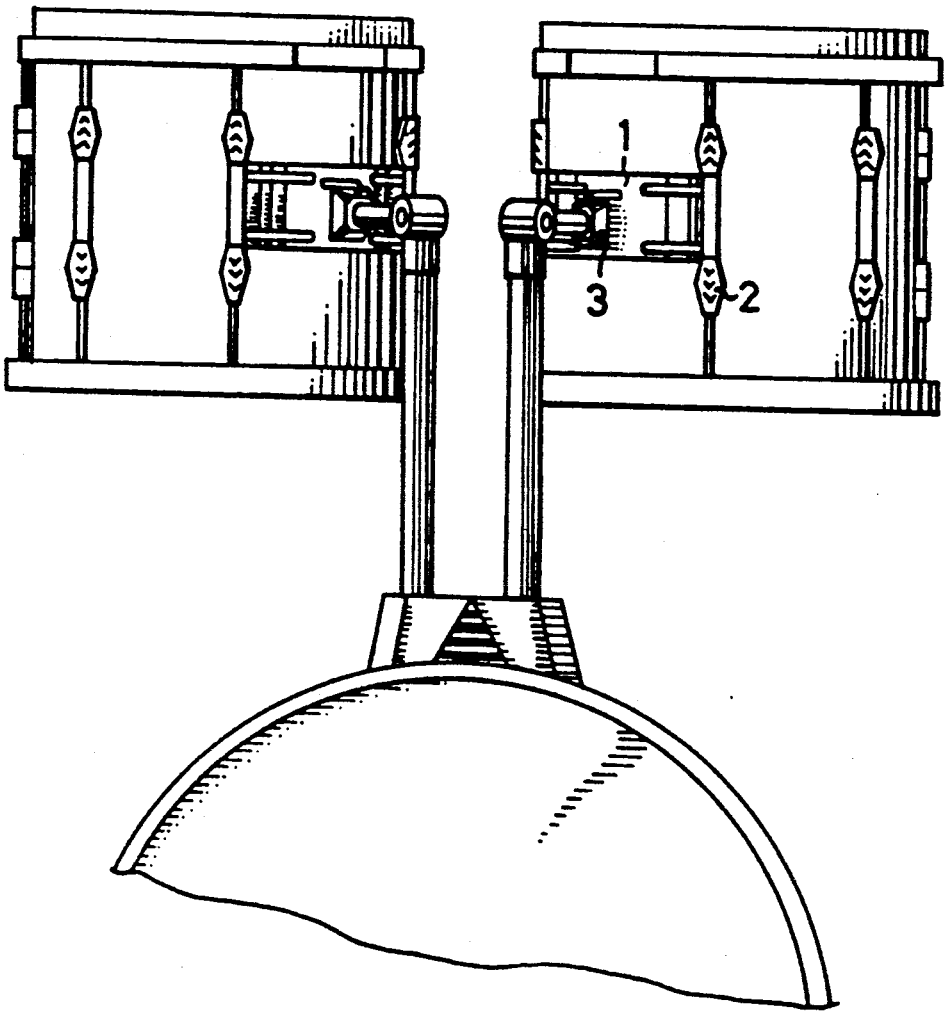
FIG. 2 is a perspective view of a pair of mounts in accordance with the present invention each fixed to a musical drum.
Figure 4:
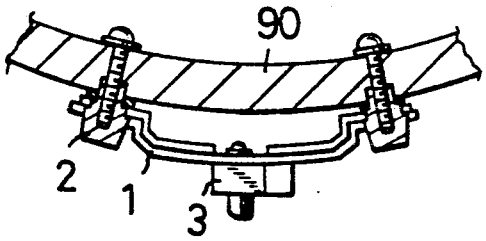
FIG. 4 is a cross-sectional top view along line 4—4 of FIG 3. showing the mount mounted to a musical drum.

With reference to the drawings and initially to FIG. 1, a clamp mount 1 for a musical drum comprises an essentially rectangular metal strip 10 with slightly indented tabs 11 formed on either end thereof. Indentations 13 formed along the edges of the metal strip 10 provide strengthened reinforcement due to strain hardening. A center portion of the clamp mount is formed with four through holes 12 arranged in a diamond-shaped pattern. A clamp 3 (FIGS. 2 and 4) is bolted to the clamp mount 1 by means of the four through holes 12.

Figure 3:
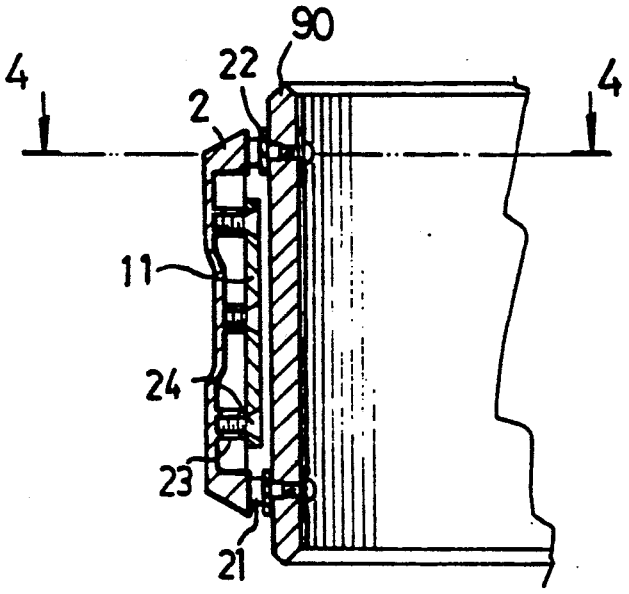
FIG. 3 is a cross-sectional side view of FIG. 1 mounted to a musical drum.

The clamp mount 1 attaches at either end thereof to the rear of any consecutive pair of threaded receptacles 2 disposed along an outer wall 90 of the drum for receiving the tightening screws which mount the drum head over the drum body. Each tab 11 of the strip 10 + is therefore formed with three vertically arranged through holes 14, by means of which the mount is screwably fixed behind a pair of threaded receptacles 2, as shown in FIG. 3. The threaded receptacles 2 are then fixed against the wall of the drum, completing the process of mounting.

As various possible embodiments might be made of the above invention without departing from the scope of the invention, it is to be understood that all matter herein described or shown in the accompanying drawing is to be interpreted as illustrative and not in a limiting sense. Thus it will be appreciated that the drawings are exemplary of a preferred embodiment of the invention.

I claim:

1. A clamp mount for securing a musical drum to a clamp on a drum stand, the musical drum having a head and a body and at least a pair of receptacles attached on the drum body receiving tightening screws which mount the head over the body, each receptacle being substantially spaced across an air gap from the drum body except at the positions of attachment of the receptacle to the drum body and having an inner face facing the drum body, said clamp mount comprising:

a rectangular convex-shaped metal strip having indented mounting tabs formed at both ends thereof, each end mounting tab being securable to a corresponding one of said receptacles at said inner face of the receptacle in its air spaced relationship from the drum body; and a plurality of through holes provided in a center portion of the metal strip for the securing thereto of the clamp on the drum stand.

* * * * *

UNITED STATES PATENT AND TRADEMARK OFFICE

CERTIFICATE OF CORRECTION

PATENT NO. : 5,076,132

DATED : December 31, 1991

INVENTOR(S) : Wu H. HSIEH

It is certified that error appears in the above-identified patent and that said Letters Patent is hereby corrected as shown below:

[57] Abstract, line 6, change "rin" to --rim--.

Column 1, line 33, change "strain" to --strains--.

Column 1, line 48, before "fixed" insert --securably--.

Figure 5:
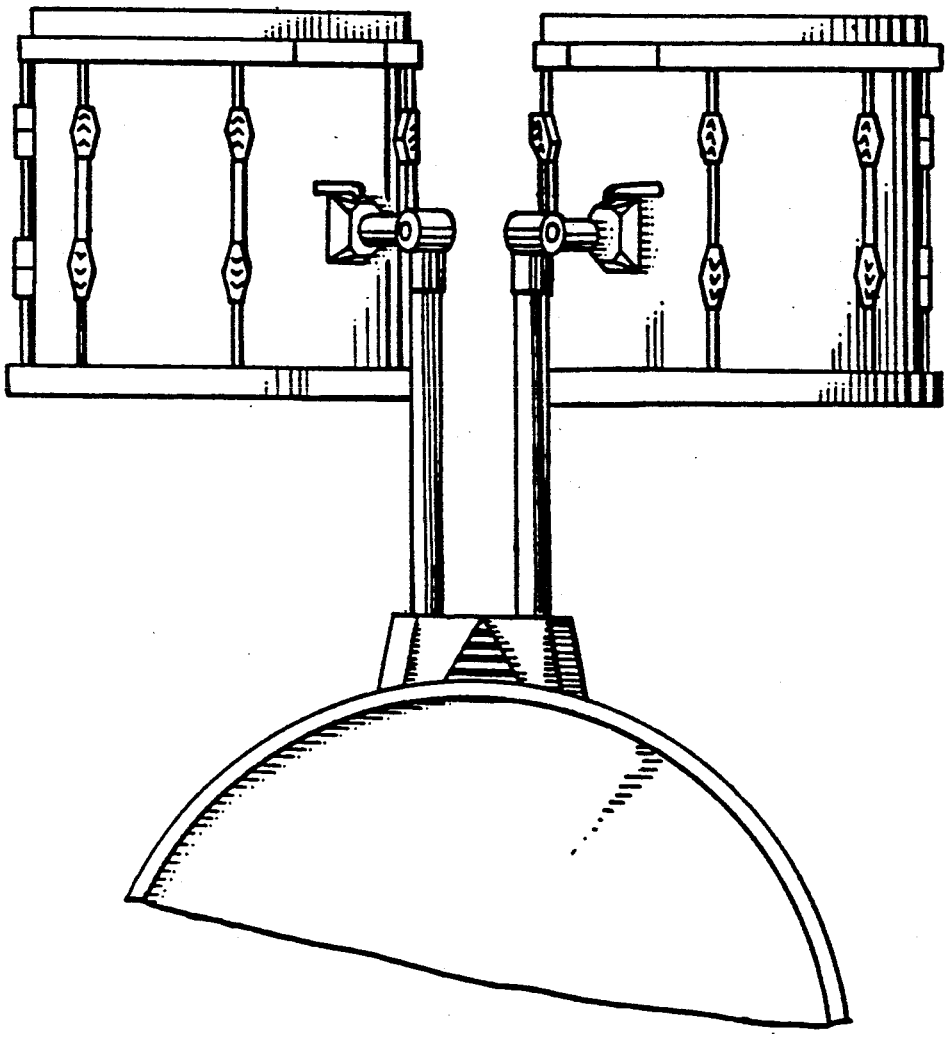
FIG. 5 PRIOR ART
FIG. 5 is a prior art.
Figure 6:
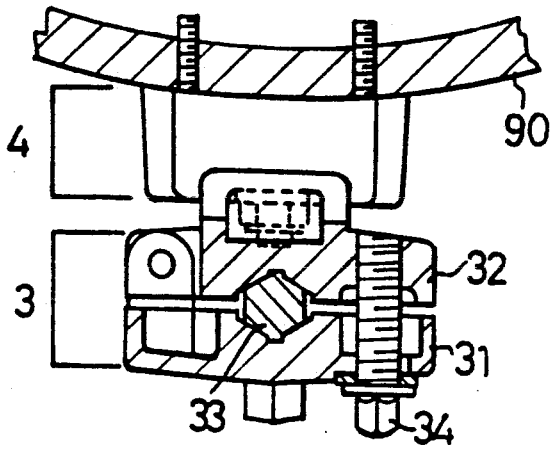
FIG. 6 PRIOR ART
FIG. 6 is a cross-sectional top view of FIG. 5 mounted to a musical drum.
Figure 7:
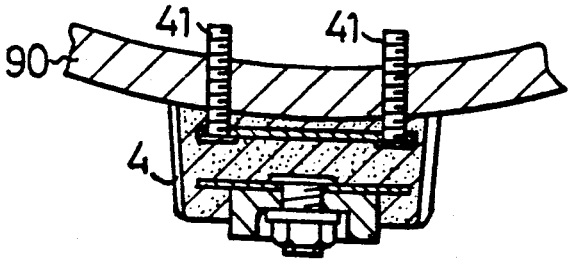
FIG. 7 PRIOR ART
FIG. 7 is a cross-sectional top view of the mount of FIG. 6.

Column 2, lines 13-14, change "FIG. 5 mounted to a musical drum;" to --a clamping device and a mount according to prior art;--.

Column 2, line 34, after "10" delete --+--.

Signed and Sealed this

Thirtieth Day of March, 1993

*Attest:*

STEPHEN G. KUNIN

*Attesting Officer*

*Acting Commissioner of Patents and Trademarks*